US005238131A

United States Patent [19]

Chase

[11] Patent Number: 5,238,131

[45] Date of Patent: Aug. 24, 1993

[54] PLASTIC MOLDED CAP

[75] Inventor: Brian Chase, Woodland Hills, Calif.

[73] Assignee: The Gillette Company, Boston, Mass.

[21] Appl. No.: 891,348

[22] Filed: May 29, 1992

[51] Int. Cl.[5] ..... B65D 41/04

[52] U.S. Cl. ..... 215/334; 215/6; 220/288; 220/307; 220/521

[58] Field of Search ..... 215/329, 334, 228, 6; 220/256, 288, 307, 521, 212, 254

[56] References Cited

U.S. PATENT DOCUMENTS

| | | | |
|---|---|---|---|
| 1,838,042 | 12/1931 | Schwartz | 220/288 X |
| 1,858,134 | 5/1932 | Booth et al. | 220/521 X |
| 2,084,568 | 6/1937 | White | 220/288 X |
| 2,243,290 | 5/1941 | Schwartz | 220/288 |
| 2,629,508 | 2/1953 | Prager | 220/521 X |
| 2,727,547 | 12/1955 | Moon, 3rd | 220/307 X |
| 2,766,796 | 10/1956 | Tupper | 220/521 |
| 3,085,709 | 4/1963 | Klein . | |
| 3,966,080 | 6/1976 | Bittel | 220/269 |
| 4,094,437 | 6/1978 | Hayashida | 220/374 |
| 4,182,475 | 1/1980 | Freund | 229/5.7 |
| 4,231,486 | 11/1980 | Bock | 220/266 |
| 4,761,319 | 8/1988 | Kraus et al. | 220/307 X |
| 4,770,318 | 9/1988 | Earl | 220/307 |
| 4,776,972 | 10/1988 | Barrett | 220/521 X |
| 5,005,759 | 4/1991 | Bouche | 220/307 X |
| 5,115,930 | 5/1992 | Lohrman et al. | 215/227 |

FOREIGN PATENT DOCUMENTS

| | | | |
|---|---|---|---|
| 1112358 | 4/1956 | France | 215/334 |

*Primary Examiner*—Allan N. Shoap
*Assistant Examiner*—Stephen Cronin
*Attorney, Agent, or Firm*—Stephan P. Williams

[57] ABSTRACT

A plastic molded cap made in two parts to have a cap body, and a closing disc. Making a cap in two parts conserves material and permits fine molding detail substantially without defects to be placed at the proximal end of the cap.

4 Claims, 1 Drawing Sheet

PLASTIC MOLDED CAP

The present application relates to plastic molded cap made in two pieces to conserve material and to permit fine molding detail substantially without defects to be placed at the proximal end of the cap.

BACKGROUND OF THE INVENTION

Molded plastic caps that have exterior diameter larger than the container to which they are attached are well known. They typically have an annular support wall with an integral top and a centrally disposed closure projecting from the top supported by a series of ribs projecting from the interior surface of the annular wall to the exterior surface of the closure. The closure typically has threads on its interior surface which mate with cooperating threads on the container to be capped.

When one wishes to put fine detail, for example decorative detail, on the proximal end of the cap, one can experience difficulty. Because of the molding process, it is usually necessary to place the parting line of the mold adjacent the open proximal end of the cap. This makes it difficult to place fine molding detail in this position because one is likely to get molding defects at the parting line of the mold. If one wishes to put fine molding detail at the proximal end of the cap one may place the proximal end away from the parting line of the mold. This limits the shapes that can be molded or increases the amount of plastic that must be used.

It would be useful to be able to make molded plastic caps with fine molding detail on the proximal end of the cap using only a minimum amount of plastic.

SUMMARY OF THE INVENTION

The present invention shows a plastic molded cap which permits the user to put fine molded detail substantially without defect at the proximal end of the cap while still conserving plastic.

The present invention relates to a plastic molded cap made in two parts; a cap body and a closing disc. The cap body includes an annular wall with a centerline, an interior surface, a first diameter, an open proximal end for receiving the container and an open distal end for receiving a closing disc. The proximal end of the annular wall has fine molding detail substantially free of molding defects. The distal end of the annular wall preferably has a detent recess for securely holding a closing disc. A closing disc is used to close the open distal end of the annular wall and preferably has an annular projection to snap-fit within the annular recess on the annular wall to securely hold the two together. Instead of using an internal detent and projection mechanism, the closing disc could snap over the exterior periphery of the annular wall. A large variety of means for connecting the disc to the cap body are possible including gluing, ultrasonic welding or other types of mechanical connection. Within the annular wall is supported an annular closure which has a centerline aligned with the centerline of the annular wall. The annular closure has an open proximal end for receiving the container and a closed distal end. Depending on the type of container which the cap is intended to close, there may be a variety of ways of securing the cap to the container. In the preferred embodiment, there are corresponding threads on the interior surface of the annular closure and the corresponding exterior surface of the container. Other means could be used, like a detent snap-fitting or a variety of connections suitable for the particular intended use of the cap. A continuous web connects the annular wall and the annular closure together. In the preferred embodiment the web is placed at an angle so as to recess the annular closure within the proximal end of the annular wall. The angle can be selected for the use intended for the cap. In this preferred embodiment, the angle of the web matches the angle of the opposed surface of the container.

BRIEF DESCRIPTION OF THE DRAWINGS

The foregoing and other features of this invention will be more particularly described in connection with the preferred embodiment, and with reference to the accompanying drawings, wherein.

DETAILED DESCRIPTION OF THE PREFERRED EMBODIMENT

Figure 1:
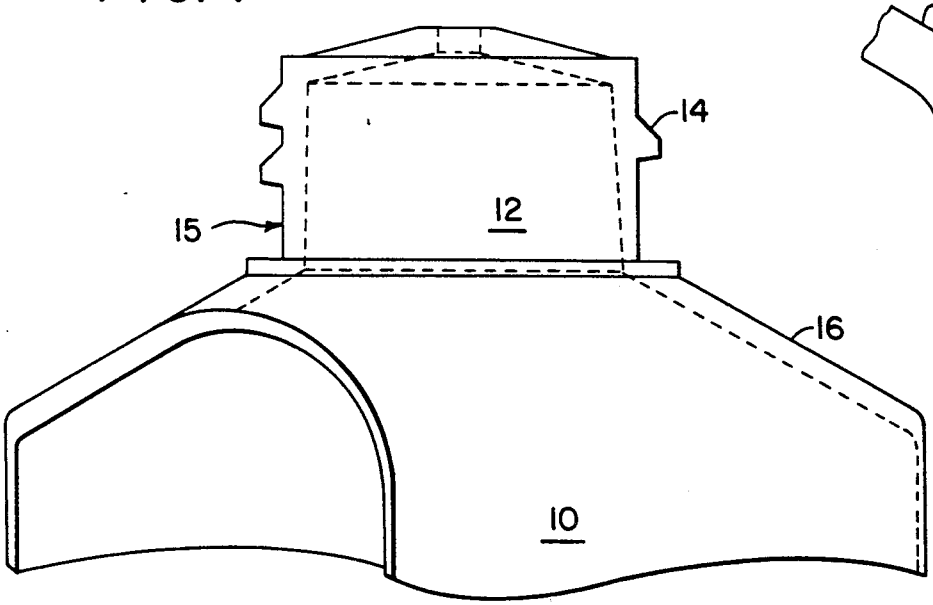
FIG. 1 shows a plan view partly in section of a container with which the cap of the present invention may be used.

Referring now to FIG. 1 there is shown a container 10 with an exit portion 12 having threads 14 about its exterior surface 15 and having a sloping top wall 16.

Figure 2:
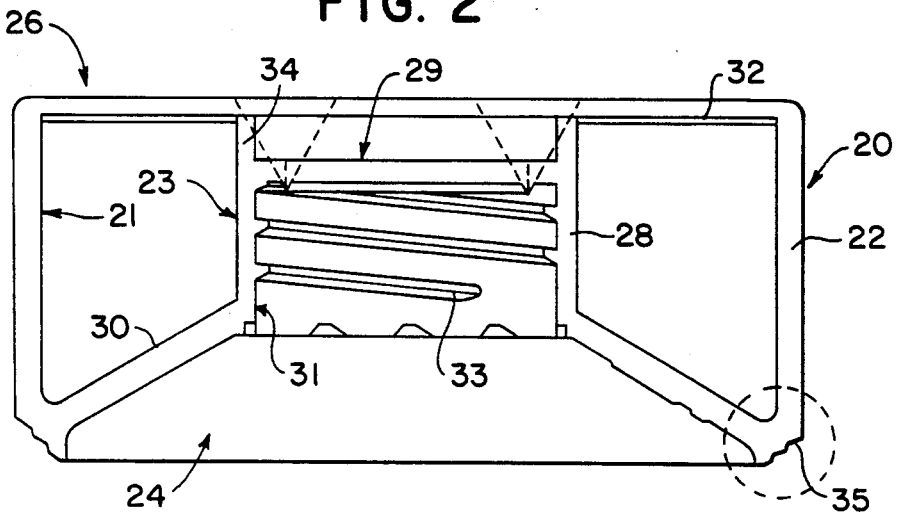
FIG. 2 shows a transverse cross section through the body section of the cap of the present invention.

Referring now to FIG. 2 there is shown a cap body 20 with a surrounding annular wall 22 having an open proximal end 24 for receiving container 10 and an open distal end 26. An annular closure 28 is supported within annular wall 22 of body 20. The center lines of annular closure 28 and annular wall 22 are coaxially aligned. A continuous support web 30 extends from the interior surface 21 of annular wall 22 to the exterior surface 23 of annular closure 28 to support annular closure 28 coaxially within annular wall 20. Annular closure 28 includes a top wall 29 and an interior surface 31 which includes threads 33 which cooperate with threads 14 of container 10.

It can be seen by comparing FIGS. 1 and 2 that sloping wall 16 and support web 30 slope at a corresponding angle to one another to permit annular closure 28 to be recessed within cap body 20 and correspondingly to permit exit portion 12 of container 10 to be fully received within the open proximal end 24 of body 20.

Figure 4:
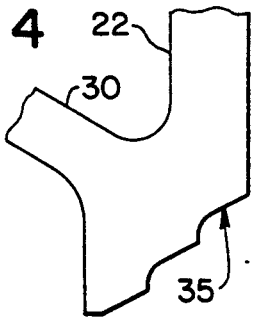
FIG. 4 shows an enlarged detail of the proximal end portion of the cap body shown in FIG. 2.

In the preferred embodiment as shown in FIGS. 1 and 2, the diameter of body portion 20 is slightly larger than the diameter of container 10 so that annular wall 22 sticks out somewhat beyond the periphery of container 10. It can be seen in FIG. 4, which is an enlarged detail of a portion of FIG. 2, that fine molding detail may be placed on the proximal portion of annular wall 22 of cap 20 to place decorative detail at this portion of the cap. In the preferred embodiment, this detail is a series of three steps 35 extending circumferentially around the cap body at the proximal end portion of annular wall 22.

Figure 3:
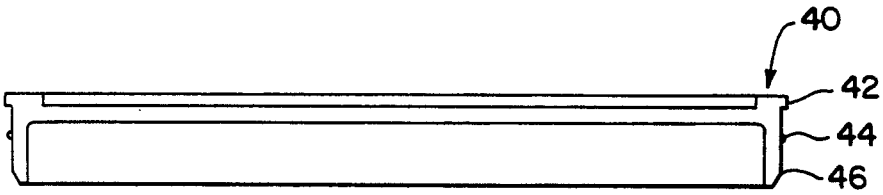
FIG. 3 shows a transverse cross section through the disc-like closure of the body section shown in FIG. 2.

Referring now to FIG. 3, there is shown a closing disk 40 which, in the preferred embodiment, snaps inside the open distal end portion 26 of cap body 20. Closing disk 40 has an outwardly extending lip 42 which abuts annular wall 22 when disk 40 is in place. Closing disc 40 also includes annular projection 44 extending preferably all the way about the exterior wall 46 of disk 40, although annular projection 44 may be discontinuous. Outer wall of closing disk 40 extends a sufficient distance in the proximal direction to allow disk 40 to be firmly and stably held in position in the open distal end 26 of cap body 20 when it is in place.

Referring now to FIG. 2, one can see a recess 32 extending all the way about the distal portion of the interior surface 21 of annular wall 22. Recess 32 receives projection 44 when closing disk 40 is inserted into the open distal end 26 of the annular wall 22, thus closing cap body 20.

Still referring to FIG. 2 there is shown a supporting wall 34 extending distally from annular closure 28 for providing a central support for closing disk 40 when closing disk 40 is placed within cap body 20.

Cap body 20 is molded as a single part with a minimum amount of plastic. Fine molding detail is provided, preferably in the form of steps 35, at the proximal end 24 of cap body 20. When closing disk 40 is snap-fit into position, a cap is provided that has the appearance of a one piece structure but which has the economy of large voids within the structure that save plastic.

Although closing disk 40 of the present invention snaps inside cap body 20, closing disk 40 could be designed to fit over the outside of the distal end of cap body 20. Although web 30 extends at a preferred angle, any convenient angle may be used. Also, the preferred embodiment of this invention shows a cap which can thread onto corresponding threads on a container. Other types of closures could be used depending upon the requirements of the container and the cap and the material that is to be maintained inside the container.

The present invention has been described in connection with certain preferred embodiments. Certain modifications to the preferred embodiments will occur to those skilled in the art. Thus, it is not intended to limit the scope of the patent protection to the structure described in this preferred embodiment, but only to limit the scope of the invention as set forth in the following claims:

1. A plastic molded cap for a container comprising:

an annular wall having a centerline, an interior surface, a first diameter, a proximal end for receiving the container, and an open distal end;

the proximal end of said annular wall having a molding detail substantially free of molding defects;

the distal end of said annular wall having a snap-fit connecting means for securely holding a closing disk;

a closing disk having cooperating snap-fit connecting means for securely holding said disk to said wall distal end;

an annular closure for the container having a centerline aligned with said centerline of said annular wall, having an interior surface and having an open proximal end for receiving the container and having a closed distal end;

a disk support extending distally from said closure and aligned for providing central support for said closing disk; and a continuous web connecting said annular wall and said closure.

2. The molded cap of claim 1 wherein said closure includes threads on its interior surface adapted for receiving similar threads on the container.

3. The cap of claim 2 wherein said web tapers with respect to said annular wall centerline to recess said closure from the proximal end of said annular wall.

4. The cap of claim 3 wherein said snap-fit connecting means includes a detent recess on the interior surface of said annular wall near said annular wall distal end and said cooperating snap-fit connecting means includes an annular projection extending at least partially about the periphery of said closing disk.

* * * * *